US006952550B2

(12) United States Patent
Ohkuwa et al.

(10) Patent No.: US 6,952,550 B2
(45) Date of Patent: Oct. 4, 2005

(54) TONER SUPPLY ROLL

(75) Inventors: Kenichi Ohkuwa, Iwakura (JP); Eiji Yasui, Nakashima-gun (JP); Kazunori Toyama, Nagoya (JP)

(73) Assignee: Tokai Rubber Industries, Ltd., Komaki (JP)

( * ) Notice: Subject to any disclaimer, the term of this patent is extended or adjusted under 35 U.S.C. 154(b) by 161 days.

(21) Appl. No.: 10/694,988

(22) Filed: Oct. 29, 2003

(65) Prior Publication Data

US 2004/0086303 A1 May 6, 2004

(30) Foreign Application Priority Data

Oct. 29, 2002 (JP) ..... 2002-314739

(51) Int. Cl.[7] ..... G03G 15/08

(52) U.S. Cl. ..... 399/281; 492/56; 492/59; 492/17

(58) Field of Search ..... 399/176, 272, 399/281, 286, 313, 330, 331, 357; 492/17, 18, 56, 59

(56) References Cited

U.S. PATENT DOCUMENTS

| | | | | |
|---|---|---|---|---|
| 4,696,255 A | | 9/1987 | Yano et al. | |
| 4,788,570 A | | 11/1988 | Ogata et al. | |
| 5,287,150 A | * | 2/1994 | Kinoshita et al. | 399/281 |
| 5,311,264 A | | 5/1994 | Kinoshita | |
| 5,655,197 A | | 8/1997 | Okada et al. | |
| 5,768,668 A | | 6/1998 | Shiraki et al. | |
| 6,480,692 B2 | * | 11/2002 | Yamazaki et al. | 399/281 |
| 6,512,911 B2 | * | 1/2003 | Arai et al. | 399/286 |
| 6,810,227 B2 | * | 10/2004 | Sakata et al. | 399/281 |
| 6,813,470 B1 | * | 11/2004 | Elbert et al. | 399/381 |
| 6,818,674 B2 | * | 11/2004 | Sakata et al. | 521/110 |

FOREIGN PATENT DOCUMENTS

| | | | |
|---|---|---|---|
| JP | 6-301281 | | 10/1984 |
| JP | 10-239985 | * | 9/1988 |
| JP | 3-155575 | | 7/1991 |
| JP | 4-55873 | | 2/1992 |
| JP | 9-274373 | | 10/1997 |

* cited by examiner

*Primary Examiner*—Robert Beatty
(74) *Attorney, Agent, or Firm*—Armstrong, Kratz, Quintos, Hanson & Brooks, LLP

(57) ABSTRACT

A toner supply roll free from occurrence of an imaging failure. The toner supply roll comprises a shaft (1) and a urethane foam layer (2) provided on an outer peripheral surface of the shaft (1), wherein when the urethane foam layer is compressed to a depth of 1 mm from an outermost surface thereof during compression thereof to a depth of 2 mm, a stress $F_0$ occurs in the urethane foam layer and when the urethane foam layer is decompressed to a depth of 1 mm after the compression thereof to a depth of 2 mm, a stress $F_1$ occurs in the urethane foam layer, the urethane foam layer satisfies a relation represented by the following expression (1) at a temperature of 23±3° C. at a humidity of 50±10%:

$$F_1/F_0 \geqq 0.7 \quad (1)$$

the stresses $F_1$ and $F_0$ being expressed by a unit of Pa.

1 Claim, 2 Drawing Sheets

TONER SUPPLY ROLL

BACKGROUND OF THE INVENTION

1. Field of the Invention

The present invention relates to a toner supply roll for use in an electrophotographic apparatus such as a copying machine, a printer or a facsimile machine.

2. Description of the Art

In an image forming apparatus such as a copying machine, a printer or a facsimile machine, an image forming operation is performed, as shown in FIG. 3, by forming an electrostatic latent image of an original image on a surface of a photoreceptor drum 12, causing a toner to adhere on the electrostatic latent image to form a toner image, transferring the toner image onto a sheet, and fixing the toner image on the sheet. For the formation of the toner image, a predetermined toner (developer) is supplied onto a surface of a developer roll 17 from a toner box (not shown) by a toner supply roll 11, and then transferred onto the surface of the photoreceptor drum 12 from the surface of the developer roll 17. The thickness of a layer of the toner formed on the developer roll 17 is controlled by a layer formation blade 18. A portion of tile toner remaining on the surface of the developer roll 17 is scraped by the toner supply roll 11 thereby to be fed back into the toner box. Thus, the toner supply roll 11 is essential for a full color image forming apparatus. Conventionally, the toner supply roll 11 includes a shaft and a urethane foam layer provided on an outer peripheral surface of the shaft.

For evaluation of the toner supply roll 11, it is a conventional practice to measure the outer dimensions of the toner supply roll 11 by means of a laser beam. Further, the hardness of the urethane foam layer is also measured for the evaluation of the properties of the toner supply roll (see, for example, Japanese Unexamined Patent Publication No. 9-274373 (1997)).

However, a toner supply roll judged to have little numerical variation in dimensions and in hardness by the aforesaid evaluation methods is often determined to be inferior and unacceptable when actually used for image formation. That is, it is impossible to accurately predict whether a toner supply roll which satisfies dimensional and hardness requirements as judged by the conventional evaluation methods, is liable to cause the imaging failure when used for image formation. Hence, it is desirable to define an additional property requirement for a toner supply roll for assuredly preventing imaging failure.

In view of the foregoing, it is an object of the present invention to provide a toner supply roll which is free from the occurrence of imaging failure and a method for determining the same.

SUMMARY OF THE INVENTION

According to the present invention to achieve the aforesaid objects, there is provided a toner supply roll comprising a shaft and at least one layer provided on an outer peripheral surface of the shaft, the at least one layer comprising an outermost urethane foam layer which satisfies the following: when the urethane foam layer is compressed to a depth of 1 mm from an outermost surface thereof during compression thereof to a depth of 2 mm, a stress $F_0$ occurs in the urethane foam layer and when the urethane foam layer is decompressed to a depth of 1 mm after the compression thereof to a depth of 2 mm, a stress $F_1$ occurs in the urethane foam layer, the urethane foam layer satisfies a relation represented by the following expression (1) at a temperature of 23±3° C. at a humidity of 50±10%:

$$F_1/F_0 \geqq 0.7 \quad (1)$$

the stresses $F_1$ and $F_0$ being expressed by a unit of Pa.

The subject invention further comprehends a method for determining whether a toner supply roll may be free of imaging failure, the method comprising measuring the stresses $F_0$ and $F_1$ in accordance with the above procedure and evaluating the roll in accordance with expression (1) above.

In view of the fact that the conventional evaluation methods involving measurements of the dimensions and the hardness of the toner supply roll fail to properly and accurately evaluate a toner supply roll for possible imaging failure in the formation of a copy image or the like, the inventors of the present invention conducted intensive studies to find an additional property requirement for a toner supply roll to help predict possible imaging failure. The inventors investigated the cause of the imaging failure associated with the toner supply roll, and found that a toner supply roll fails to uniformly supply a toner onto a developer roll if the outermost urethane foam layer thereof has a low shape recovery rate. On the basis of this finding, the inventors further conducted studies on the shape recovery (shape recovery rate) of a toner supply roll. As a result, the inventors discovered that a toner supply roll is free from the occurrence of the imaging failure if a stress $F_0$ occurring in the urethane foam layer when the urethane foam layer is compressed to a depth of 1 mm from an outermost surface thereof during compression thereof to a depth of 2 mm and a stress $F_1$ occurring in the urethane foam layer when the urethane foam layer is decompressed to a depth of 1 mm after the compression thereof to a depth of 2 mm, satisfy the aforesaid relation (1) under the aforesaid conditions. Thus, the inventors attained the present invention.

DESCRIPTION OF THE PREFERRED EMBODIMENTS

The present invention will hereinafter be described in detail by way of an embodiment thereof.

Figure 1:
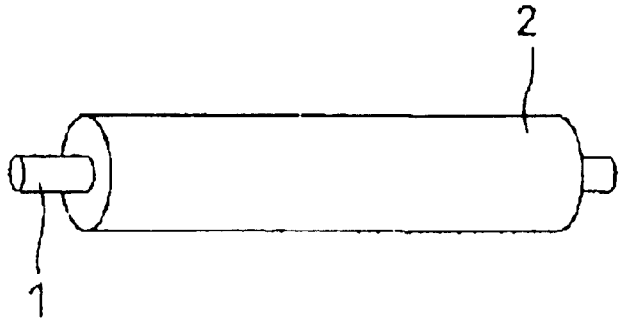
FIG. 1 is a perspective view illustrating an exemplary toner supply roll according to the present invention.

A toner supply roll according to the present invention may have a single layer structure, for example, which includes a shaft 1 and a urethane foam layer 2, provided on an outer peripheral surface of the shaft 1 as shown in FIG. 1.

The structure of shaft 1 is not particularly limited, but may be a solid metal core shaft or a hollow cylindrical metal shaft having a hollow interior. The shaft 1 may be composed of a stainless steel, aluminum or plated iron.

A urethane material for the urethane foam layer 2 may contain a polyol and an isocyanate.

The polyol is not particularly limited, as long as it is of the type generally used for a urethane material. Examples of the polyol include olefin polyols such as polyether polyols, polyester polyols, polycarbonate polyols, polycaprolactone polyols, polybutadiene polyols and polyisoprene polyols, which may be used either alone or in combination.

The isocyanate is not particularly limited, as long as it is a polyisocyanate having two or more functional groups. Examples of such isocyanates include tolylene diisocyanate (TDI) (a 2,4-isomer, a 2,6-isomer or a mixture of 2,4- and 2,6-isomers), hexamethylene diissocyanate (HDI), 4,4'-diphenylmethane diisocyanate (MDI), carbodiimide-modified MDI, polymeric polyisocyanate, o-toluidine diisocyanate (TODI), naphthylene diisocyanate (NDI), xylylene diisocyanate (XDI) and polymethylene polyphenylisocyanate, which may be used either alone or in combination. Among these isocyanates, tolylene diisocyanate (TDI) is preferred for the reduction of the hardness of the urethane foam layer.

The amount of the isocyanate with respect to the polyol is preferably 90 to 120, more preferably 100 to 110 as expressed as an isocyanate index (NCO index). The NCO index is herein defined as the equivalent of the isocyanate based on 100 equivalents of the total of materials containing isocyanate-reactive hydroxyl groups.

In addition to the polyol and the isocyanate, one or more of an electrically conductive agent, a foaming agent, a catalyst, a foam stabilizer, an anti-oxidant, a colorant and a flame retarder may be added to the urethane material as necessary.

An ion conductor or an electron conductor may be employed as the electrically conductive agent.

Examples of the ion conductor include quaternary ammonium salts, phosphoric esters, sulfates, borates, phosphates, aliphatic polyvalent alcohols, and sulfates of aliphatic alcohols, which may be used either alone or in combination.

Examples of the electron conductor include powdery metals such as aluminum powder and stainless steel powder, electrically conductive metal oxides such as c-ZnO, c-$TiO_2$, c-$Fe_3O_4$ and c-$SnO_2$, and powdery electric conductors such as graphite and carbon black, which may be used either alone or in combination. The prefix "c-" used above means "electrically conductive".

The electrically conductive agent is preferably present in the urethane material in a proportion of 0.01 to 10 parts by weight (hereinafter referred to simply as "parts"), more preferably 0.1 to 5 parts, based on 100 parts of the polyol (base polymer) of the urethane material.

A preferred example of the foaming agent is water. Water as the foaming agent is preferably present in the urethane material in a proportion of 0.3 to 2.5 parts based on 100 parts of the polyol.

Examples of the catalyst include a tertiary amine catalyst and an organic metal compound.

Specific examples of the tertiary amine catalyst include: monoamines such as triethylamine (TEA), N,N-dimethylcyclohexylamine (DMEDA); diamines such as N,N,N',N'-tetramethylethylenediamine (TMEDA); triamines such as N,N,N',N",N"-pentamethyldiethylenetriamine (PMDETA); cyclic amines such as triethylenediamine (TEDA); alcoholamines such as dimethylaminoethanol (DMEA); and etheramines such as bis(2-dimethylaminoethyl) ether (BDMEE). These amine catalysts may be used either alone or in combination.

The tertiary amine catalyst is preferably present in the urethane material in a proportion of 0.1 to 3 parts based on 100 parts of the polyol.

Specific examples of the organic metal compound include stannous octoate, dibutyltin diacetate, dibutyltin dilaurate and dibutyltin thiocarboxylate, which may be used either alone or in combination.

The organic metal compound is preferably present in the urethane material in a proportion of 0.05 to 0.5 parts based on 100 parts of the polyol.

Examples of the foam stabilizer include silicone based foam stabilizers (polyoxyalkylene-dimethylpolysiloxane copolymers) and non-silicone based foam stabilizers.

Figure 2:
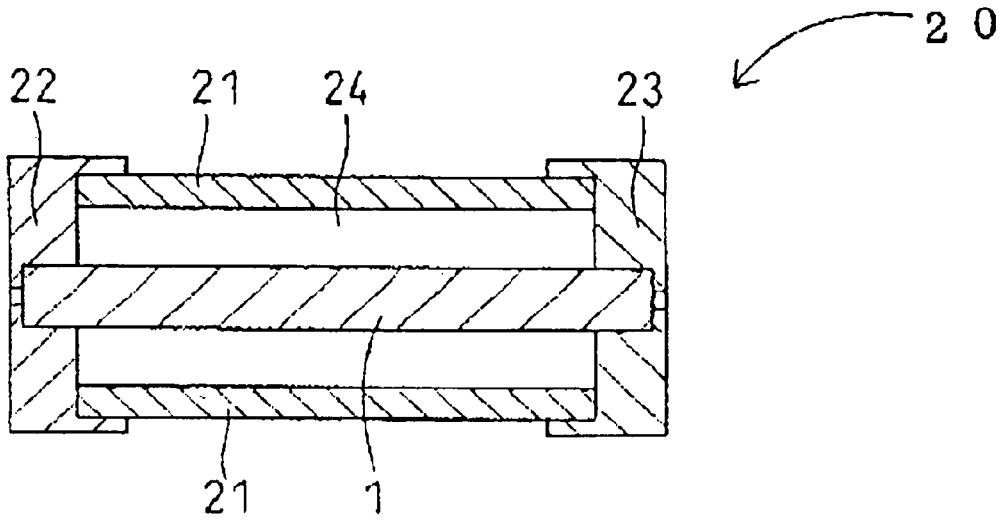
FIG. 2 is a sectional view for showing an exemplary production method for the toner supply roll according to the present invention.
Figure 3:
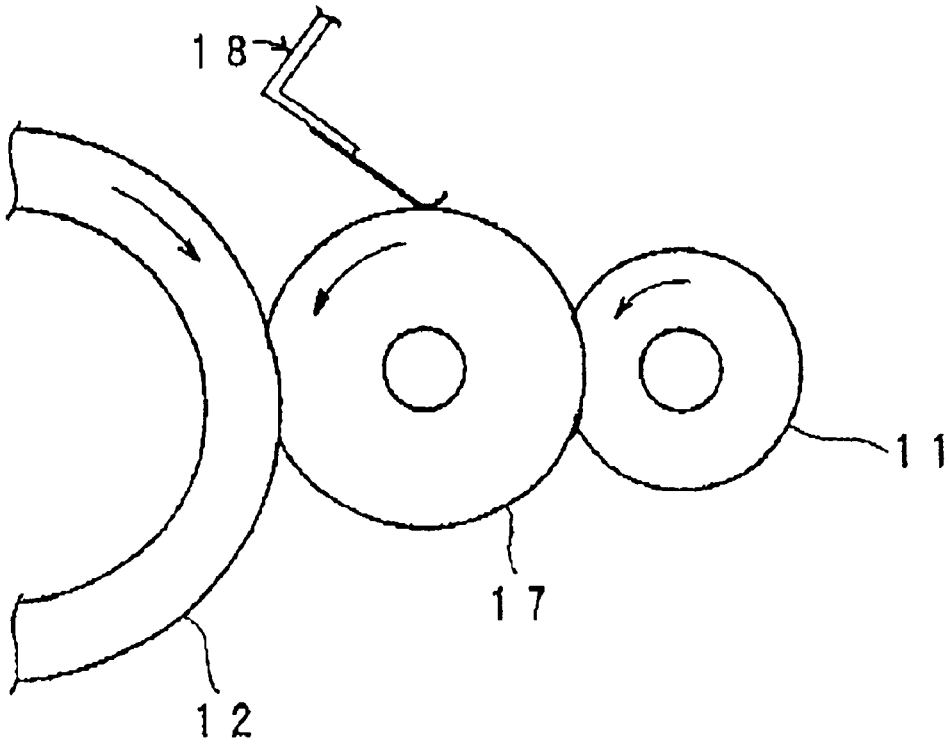
FIG. 3 is a diagram illustrating a developing section of an image forming apparatus.

The toner supply roll according to the present invention is produced, for example, in the following manner. As shown in FIG. 2, a mold 20 is prepared, which includes a cylinder 21 having substantially the same length as the axial length of the urethane foam layer of the toner supply roll, and caps 22, 23 for closing the opposite ends of the cylinder 21. While the shaft 1 is positioned within the cylinder 21 of the mold 20, the opposite ends of the cylinder 21 are closed with the caps 22 and 23 with opposite ends of the shaft 1 being supported by the caps 22, 23. Thus, a cavity 24 which provides the final shape of the intended urethane foam layer is defined within the cylinder 21. After a premixed polyol is prepared by mixing the polyol and the electrically conductive agent and, as required, the catalyst, the foaming agent and the foam stabilizer, the isocyanate is mixed with the premixed polyol. The resulting mixture is injected into the cavity 24 of the mold, and heated in an oven at a predetermined temperature (for example, at about 60° C.) for a predetermined period (for example, about 30 minutes) to thereby foam and cure the mixture. Thereafter, the resulting product is unmolded. Thus, the toner supply roll of a single layer structure is provided which includes the shaft 1 and the urethane foam layer 2 provided on the outer peripheral surface of the shaft 1 as shown in FIG. 1.

The urethane foam layer typically has a thickness of 2 mm to 8 mm, preferably 3 mm to 6 mm.

The structure of the inventive toner supply roll is not limited to the single layer structure shown in FIG. 1, but the toner supply roll may be of a multi-layer structure including two or more layers. In the case of the toner supply roll of the multi-layer structure, however, at least the outermost layer should be the urethane foam layer.

The inventive toner supply roll should satisfy the following property requirement. More specifically, a stress $F_0$ occurring in the urethane foam layer of the toner supply roll when the urethane foam layer is compressed to a depth of 1 mm from an outermost surface thereof during compression thereof to a depth of 2 mm and a stress $F_1$ occurring in the urethane foam layer when the urethane foam layer is decompressed to a depth of 1 mm after the compression thereof to a depth of 2 mm, are measured at a temperature of 23±3° C. at a humidity of 50±10%. On the bases of the stresses $F_1$ and $F_0$ thus measured, a value $F_1/F_0$ is calculated, which should satisfy a relation represented by the following expression (1):

$$F_1/F_0 \geqq 0.7 \quad (1)$$

wherein the stresses $F_1$ and $F_0$ are expressed by a unit of Pa. For the measurement of the stresses $F_1$ and $F_0$, a meter MODEL1605 (available from Aikoh Engineering Co., Ltd.) may be employed.

When the inventive toner supply roll satisfying the relation represented by the expression (1) above is actually incorporated for evaluation in one of any of various electrophotographic apparatuses for image formation, the toner supply roll provides an excellent evaluation result. Thus, the inventive toner supply roll has excellent properties.

Next, an explanation will be given to examples and comparative examples.

Prior to the explanation of the examples and the comparative examples, ingredients employed for formation of urethane foam layers of toner supply rolls will be described below.

Tri-functional Polyol

EP240 available from Mitsui Chemicals

Curing Catalyst

KAORIZER No.31 available from Kao Corporation

Foaming Agent

Water

Foam Stabilizer

Silicone based foam stabilizer (L5366 available from Nippon Uniker Co., Ltd.)

Isocyanate 2,4-tolylene diisocyanate (TDI-100 available from Mitsui Chemicals)

Ion Conductor

Quaternary ammonium salt (A902 available from Japan Carlit Co., Ltd.)

EXAMPLE 1

A urethane material was prepared by mixing the ingredients in proportions as shown in Table 1, and a toner supply roll was produced in the manner described above with reference to FIG. 2. More specifically, a mold as shown in FIG. 2 was first prepared, and a metal core shaft 1 (having a diameter of 5 mm and composed of SUS304) was placed within a cylinder 21 of the mold. A premixed polyol was prepared by blending the polyol, the electrically conductive agent, the curing catalyst, the foaming agent and the foam stabilizer in a ratio as shown in Table 1, and then mixed with the isocyanate in a predetermined ratio. A suitable amount of the resulting mixture was injected into the cavity 24 of the mold, and heated in an oven at 60° C. for 30 minutes to thereby foam and cure the mixture. Thereafter, the resulting product was unmolded. Thus, a toner supply roll of a single layer structure was produced, which the roll including a urethane foam layer (having a thickness of 4 mm) provided on the outer peripheral surface of the shaft (see FIG. 1).

EXAMPLES 2 AND 3 COMPARATIVE EXAMPLES 1 TO 3

Toner supply rolls were produced in substantially the same manner as in Example 1, except that the ingredients were blended in ratios as shown in Tables 1 and 2.

TABLE 1

(Parts)

| | Example | | |
|---|---|---|---|
| | 1 | 2 | 3 |
| Tri-functional polyol | 100 | 100 | 100 |
| Curing catalyst | 0.5 | 0.5 | 0.5 |
| Foaming agent (water) | 1.5 | 1.5 | 1.5 |
| Foam stabilizer | 1 | 1 | 1 |
| Isocyanate | 0.5 | 0.3 | 0.5 |
| Ion conductor | 1.5 | 1.5 | 1.5 |
| NCO index | 105 | 105 | 104 |

TABLE 2

(Parts)

| | Comparative Example | | |
|---|---|---|---|
| | 1 | 2 | 3 |
| Tri-functional polyol | 100 | 100 | 100 |
| Curing catalyst | 0.5 | 0.5 | 0.5 |
| Foaming agent (water) | 1.5 | 1.5 | 1.5 |
| Foam stabilizer | 1 | 1 | 1 |
| Isocyanate | 1.5 | 1.4 | 1.5 |
| Ion conductor | 1.5 | 1.5 | 1.5 |
| NCO index | 103 | 103 | 102 |

The toner supply rolls of the examples and the comparative examples thus produced were each evaluated for the following characteristic properties in the following manners. The results are shown in Tables 3 and 4.

Shape Recovery

A stress $F_0$ occurring in the urethane foam layer of the toner supply roll when the urethane foam layer was compressed to a depth of 1 mm from the outermost surface thereof during compression thereof to a depth of 2 mm and a stress $F_1$ occurring in the urethane foam layer when the urethane foam layer was decompressed to a depth of 1 mm after the compression thereof to a depth of 2 mm were measured at a temperature of 23° C. at a humidity of 50%. On the bases of the stresses $F_1$ and $F_0$ thus measured, a value $F_1/F_0$ was calculated. For the measurement of the stresses $F_1$ and $F_0$, a meter MODEL1603 (available form Aikoh Engineering Co., Ltd.) was employed.

Roll Dimension

The outer diameter and fluctuation of the toner supply roll were measured at three points by means of a dimension meter LS-5000 (available from Keyence Corporation) by rotating the roll at 48 rpm.

Hardness of Roll (Load Required to Compress Roll to Depth of 1 mm)

For the determination of the hardness of the surface of the toner supply roll, a load required to compress the urethane foam layer to a depth of 1 mm was measured by lowering a probe at a rate of 10 mm/sec by means of a meter MODEL1605 (available from Aikoh Engineering Co., Ltd.)

Occurrence of Ghost

The toner supply roll was incorporated in ai laser beam Sprinter, and an image obtained after 5000 sheets were printed was evaluated.

Density Inconsistency

The toner supply roll was incorporated in a laser bean printer for image formation with the use of nonmagnetic single-component color toners, and allowed to stand under low-temperature and low-humidity conditions (15° C.×10%) for three days. Thereafter, 5000 sheets printed with a print ratio of 5% were outputted. Then, images formed on the basis of various densities and patterns at the initial output and after the output of the 5000 printed sheets (endurance test) were compared with each other for evaluation. In Tables 3 and 4, a symbol ○ indicates that the uniform images were obtained without density inconsistency, and a symbol X indicates that the images suffered from density inconsistency.

TABLE 3

| | Example | | |
|---|---|---|---|
| | 1 | 2 | 3 |
| Stress $F_0$ (Pa) | $2.0 \times 10^6$ | $2.2 \times 10^6$ | $1.9 \times 10^6$ |
| Stress $F_1$ (Pa) | $1.7 \times 10^6$ | $1.65 \times 10^6$ | $1.58 \times 10^6$ |
| $F_1/F_0$ value | 0.85 | 0.75 | 0.83 |
| Roll dimension (mm) | 14.030 | 14.025 | 14.055 |
| Load (g) required to compress roll to depth of 1 mm | 143 | 165 | 127 |
| Occurrence of ghost | No | No | No |
| Density inconsistency | ○ | ○ | ○ |

TABLE 4

| | Comparative Example | | |
|---|---|---|---|
| | 1 | 2 | 3 |
| Stress $F_0$ (Pa) | $2.0 \times 10^6$ | $2.1 \times 10^6$ | $1.9 \times 10^6$ |
| Stress $F_1$ (Pa) | $1.3 \times 10^6$ | $1.3 \times 10^6$ | $1.3 \times 10^6$ |
| $F_1/F_0$ value | 0.65 | 0.62 | 0.68 |
| Roll dimension (mm) | 14.065 | 14.057 | 14.066 |
| Load (g) required to compress roll to depth of 1 mm | 145 | 150 | 130 |
| Occurrence of ghost | No | No | No |
| Density inconsistency | X | X | X |

As can be understood from the results shown in Tables 3 and 4, the toner supply rolls of the examples each had a proper roll dimension and hardness (load required to compress the roll to a depth of 1 mm), and satisfied the relation $F_1/F_0 \geqq 0.7$ in the evaluation of the shape recovery. The results of the evaluation of the image formation were excellent.

The toner supply rolls of the comparative examples each had a proper roll dimension and hardness (load required to compress the roll to a depth of 1 mm), like the toner supply rolls of the examples, but did not satisfy the relation $F_1/F_0 \geqq 0.7$ in the evaluation of the shape recovery. The results of the evaluation of the image formation were not excellent.

As described above, the inventive toner supply roll is constructed such that the stress $F_0$ occurring in the urethane foam layer when the urethane foam layer is compressed to a depth of 1 mm front the outermost surface thereof during the compression thereof to a depth of 2 mm and the stress $F_1$ occurring in the urethane foam layer when the urethane foam layer is decompressed to a depth of 1 mm after the compression thereof to a depth of 2 mm satisfy the relation represented by the aforesaid expression (1) under the aforesaid measurement conditions. The inventive toner supply roll satisfying the aforesaid relation has excellent properties and is free from the occurrence of the imaging failure. The inventive toner supply roll is unlike a conventional toner supply roil which only satisfies the dimensional and hardness requirements as judged by conventional evaluation methods but may be liable to cause the imaging failure when actually used for image formation.

What is claimed is:

1. A toner supply roll comprising a shaft and at least one layer provided on an outer peripheral surface of the shaft, the at least one layer comprising an outermost urethane foam layer which satisfies the following: when the urethane foam layer is compressed to a depth of 1 mm from an outermost surface thereof during compression thereof to a depth of 2 mm, a stress $F_0$ occurs in the urethane foam layer and when the urethane foam layer is decompressed to a depth of 1 mm after the compression thereof to a depth of 2 mm, a stress $F_1$ occurs in the urethane foam layer, the urethane foam layer satisfies a relation represented by the following expression (1) at a temperature of 23±3° C. at a humidity of 50±10%:

$$F_1/F_0 \geqq 0.7 \quad (1)$$

the stresses $F_1$ and $F_0$ being expressed by a unit of Pa.

* * * * *